United States Patent [19]

Horvath

[11] 4,014,307

[45] Mar. 29, 1977

[54] BARREL FOR BALL THROWING MACHINE

[76] Inventor: Tibor Horvath, 1877 E. 27th St., Brooklyn, N.Y. 11229

[22] Filed: Apr. 12, 1976

[21] Appl. No.: 675,824

Related U.S. Application Data

[63] Continuation-in-part of Ser. No. 543,554, Jan. 23, 1975, abandoned.

[52] U.S. Cl. ..... 124/81; 124/83

[51] Int. Cl.[2] ..... A63B 69/40; F41B 11/00; F41F 17/02; F41F 17/06

[58] Field of Search ..... 124/81, 83–85, 124/56, 27–29, 21, 41, 6, 7, 73; 273/1 B, 29 A

[56] References Cited

UNITED STATES PATENTS

| | | | |
|---|---|---|---|
| 547,394 | 10/1895 | Gardy | 124/27 |
| 1,196,151 | 8/1916 | Reynolds | 124/6 |
| 1,201,626 | 10/1916 | Reynolds | 124/6 |
| 2,182,369 | 12/1939 | Barron | 124/81 |
| 2,313,409 | 3/1943 | Walker | 273/29 A X |
| 2,526,018 | 10/1950 | Foster et al. | 124/73 |
| 2,935,980 | 5/1960 | Garver | 124/73 |
| 3,102,526 | 9/1963 | Connor | 124/21 |
| 3,288,127 | 11/1966 | Bullock | 124/81 X |
| 3,838,676 | 10/1974 | Kahelin | 124/81 X |

*Primary Examiner*—Paul E. Shapiro
*Attorney, Agent, or Firm*—Peter L. Tailer

[57] ABSTRACT

A barrel for a ball throwing machine using air to expell balls from the barrel randomly directs balls within a lateral range of directions. Upper and lower crowned and centered ball contact strips extend the length of the barrel which widens laterally toward its muzzle. Adjustable side contact strips may be provided to limit the extent to which a ball may travel down one side of the barrel or the other. Some few balls remain precariously centered between the upper and lower strips for a straight throw, but most slip from between the spring tension of the upper and lower strips to reach the muzzle displaced to one side or the other to different extents. Rigidly mounted deflectors having inwardly extending surfaces on each side of the muzzle deflect balls striking them in the direction of the opposite side greatly amplifying the deviation in direction with which the balls leave the barrel. The deflectors may be adjusted to set the lateral range of directions within which balls are expelled.

13 Claims, 10 Drawing Figures

BARREL FOR BALL THROWING MACHINE

CROSS-REFERENCES TO RELATED APPLICATIONS

This application is a continuation-in-part of my patent application Ser. No. 543,554 filed 01-23-75 and now abandoned.

BACKGROUND OF THE INVENTION

1. Field of the Invention

This invention relates to barrels for ball throwing machines that throw balls by blowing them from a barrel.

2. Description of the Prior Art

Heretofore ball throwing machines have had to either direct balls from one set position of a barrel in substantially a single direction, or, if it was desirable to provide random throws in different directions as in a table tennis robot, it was necessary to provide a costly mechanism to aim the barrel in the desired random different directions. In a table tennis robot, a mechanism aiming the barrel gives a player practicing with the robot an obvious clue as to the direction each ball will be expelled. This reduces the efficiency of the machine for table tennis practice and it greatly reduces player interest in using such a ball thrower or table tennis robot.

SUMMARY OF THE INVENTION

A table tennis ball thrower with a barrel slightly flared laterally at the muzzle is provided with upper and lower ball contact strips, at least one of which extends resiliently inward so that a ball blown down the barrel is pressed between the two strips. The upper and lower strips randomly force balls from between them to different extents during their passages down the barrel so that the balls emerge from the laterally flared muzzle randomly deflected to slight extents. Inwardly extending rigidly mounted deflectors at the sides of the laterally flaring muzzle are randomly hit to different extents by the slightly deflected balls so that the rigid deflectors greatly amplify the random deflections as balls bounce therefrom to provide a wide and random lateral range of ball throws.

Without the rigidly mounted deflectors, the lateral random deflections of thrown balls caused by the upper and lower ball contact strips would only amount to a few centimeters in throws of 3 meters. With the deflectors, a thrown ball may be deflected up to one meter right or left in a throw of 3 meters. Thus the combination of a single pair of upper and lower ball contact strips and rigidly mounted deflectors is a laterally flared muzzle provides a table tennis robot which can cover a table with random throws without aiming the barrel. This makes possible a far less costly table tennis robot which is more versatile in its operation.

DESCRIPTION OF THE PREFERRED EMBODIMENTS

The ball thrower barrel 10 of this invention may be used with a ball thrower such as that described in my U.S. Pat. No. 3,911,888 issued 10-14-75. While barrel 10 could be used to accommodate balls other than those used in table tennis, this invention is mainly intended to be applied to table tennis ball throwing machines or table tennis robots.

Figure 1:
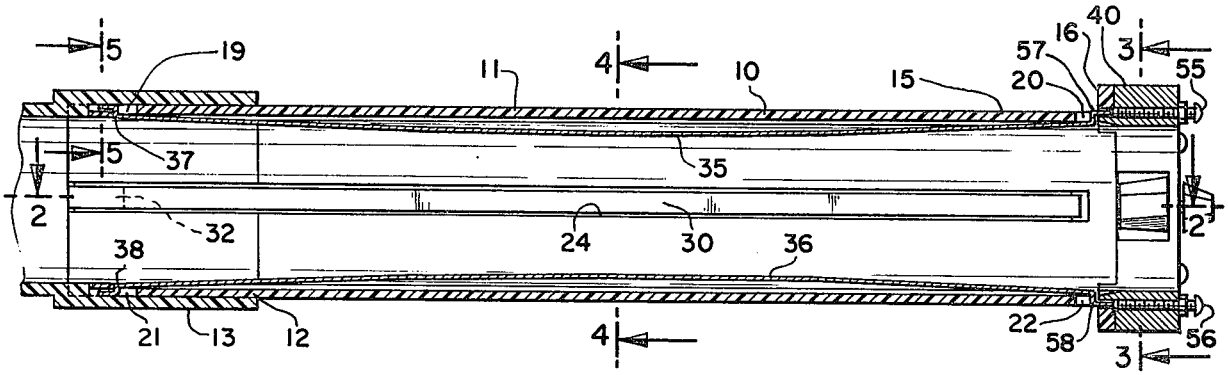
FIG. 1 is a longitudinal, vertical section through a ball thrower barrel according to a first embodiment of my invention.
Figure 2:
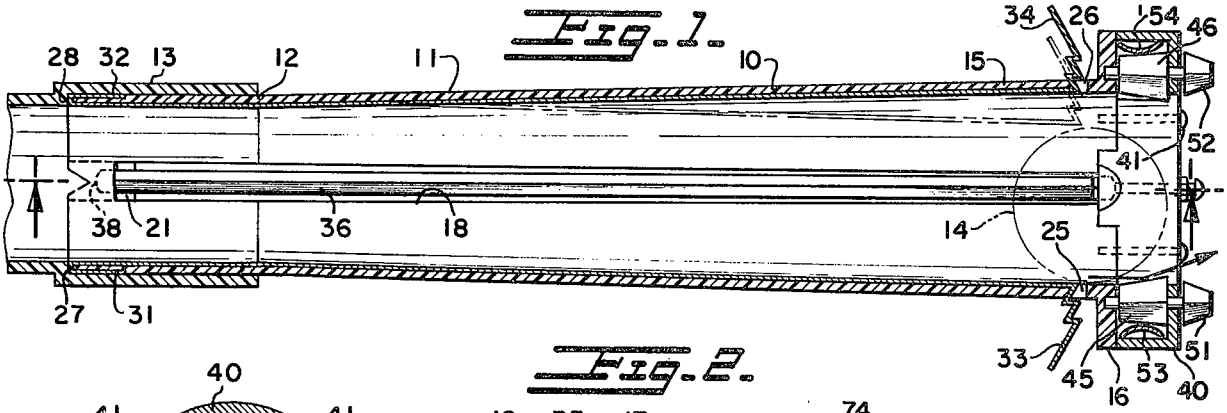
FIG. 2 is a longitudinal, horizontal section taken on line 2—2 of FIG. 1.
Figure 3:
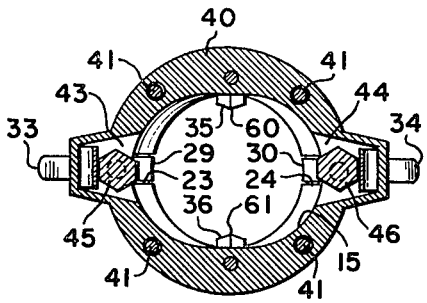
FIGS. 3 and 4 are, respectively, transverse sections taken on lines 3—3 and 4—4 of FIG. 1.
Figure 4:
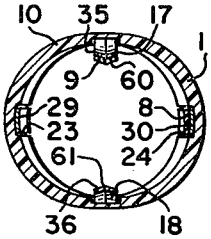
Figure 7:
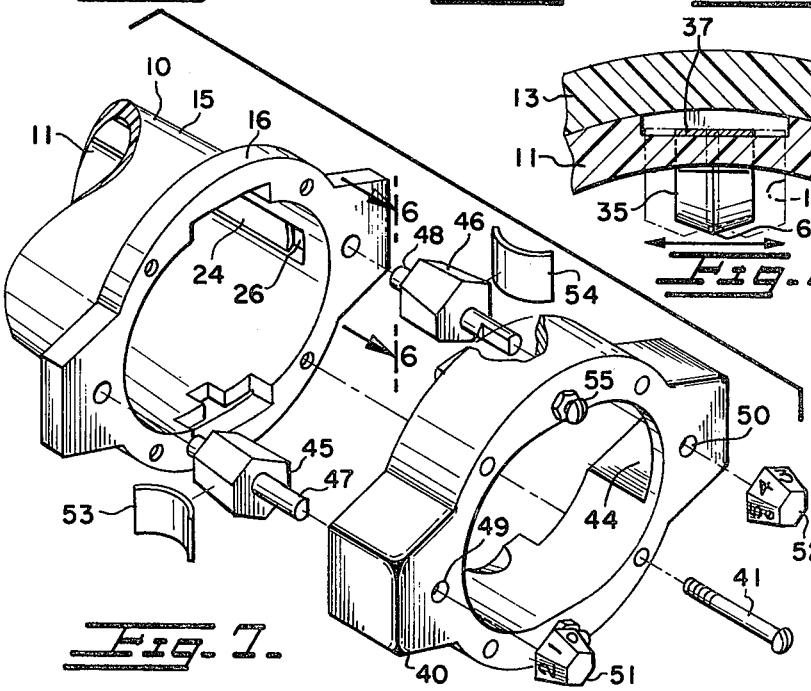
FIG. 7 is an exploded view of a fragment of the muzzle of the barrel and elements fixed thereto.

Barrel 10, as may be seen in FIGS. 1 and 2, has a tube 11 with a cylindrical rear portion 12 that telescopes into a fitting 13 of the ball thrower which blows table tennis or other balls 14 from barrel 10. As shown in FIGS. 3 and 4, the front of muzzle end 15 of tube 11 spreads out of round or diverges to be about 0.7 cm. wider than it is high. Muzzle end 15 of tube 11 terminates in a flange 16 as may be additionally seen in FIG. 7.

As shown in FIG. 4, upper and lower central longitudinal grooves 17 and 18 are formed substantially the length of tube 11. Upper groove 17 extends between the apertures 19 and 20 in the wall of tube 11, and lower groove 18 extends between the apertures 21 and 22 in the wall of tube 11. Side grooves 23 and 24 extend rearwardly from the apertures 25 and 26, respectively, to the notches 27 and 28 in the back end of tube 11.

Side contact strips 29 and 30 warp around notches 27 and 28 with hooked rear ends 31 and 32. Side strips 29 and 30 have outwardly bent front zig zag ends 33 and 34 which extend through apertures 25 and 26 to fix the flat side contact strips 29 and 30 in the side grooves 23 and 24. The rear ends of the upper and lower contact strips 35 and 36 from Z-bends 37 and 38 to extend through the apertures 19 and 21. Strips 35 and 36 are disposed in the grooves 17 and 18, and, at the muzzle end 15 of tube 11, have Z-bends 57 and 58 formed to extend through the apertures 20 and 22.

A bracket 40 is fixed by the screws 41 to the front of flange 16. Bracket 40 contains side cavities or openings 43 and 44 within which the six sided deflectors 45 and 46 are mounted by means of the shafts 47 and 48. Shafts 47 and 48 project through the apertures 49 and 50 in bracket 40 to have nobs 51 and 52 mounted thereon to rotate the deflectors 45 and 46, respectively. Detent springs 53 and 54 engage the outward facing faces of the deflectors 45 and 46 to secure them in any one of six set positions.

Figure 5:
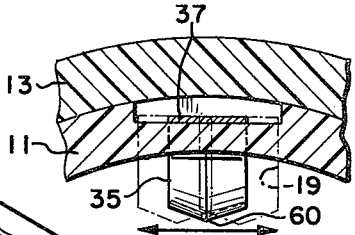
FIG. 5 is a section taken on line 5—5 through a fragment of the barrel of FIG. 1.

As shown in FIG. 5, the rear Z-bend 37 of upper contact strip 35 extends through an aperture 19 which is wider than strip 35. As shown in FIG. 2, the rear Z-bend 38 of lower contact strip 36 extends through an aperture 21 which is wider than strip 36. The longitudinal grooves 17 and 18 should taper to become wider to the rear as shown in FIG. 2 for reasons that will be hereinafter described.

As may be seen in FIG. 1, adjustment screws 55 and 56 may be turned and locked to bear against the front Z-bends 57 and 58 of the upper and lower contact strips 35 and 36. This adjusts the bow and sets the spring tension with which the upper and lower contact strips engage a ball 14 while it is being blown through tube 11 between them. As shown in FIGS. 4 and 5, the upper and lower ball contact strips 35 and 36 have sharp longitudinal crowns 60 and 61 to provide lines of contact with a ball 14.

The first embodiment of this invention functions in the following manner. Balls 14, one of which is shown in phantom lines in FIG. 2, are periodically expelled by blowing from the ball thrower having the fitting 13. As a ball 14 is blown down tube 11, it will only rarely remain centered between the upper and lower ball contact strips 35 and 36 which only contact a ball 14 with their crowns 60 and 61. Strips 35 and 36 are of spring material, such as spring brass or spring steel, and their bow is adjusted in the manner described by means of the screws 55 and 56. When a ball 14 does remain centered, it will travel straight out of barrel 10.

Figure 6:
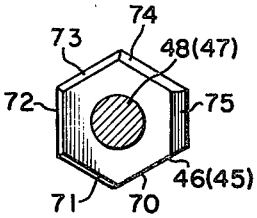
FIG. 6 is a section taken on line 6—6 of FIG. 7 showing an adjustable deflector.

In most cases a ball 14 will slip right or left from between the strips 35 and 36 so that it will proceed along one side or another of the laterally flaring tube 11 until, as shown in FIG. 2, it strikes a deflector 45 or 46. Since balls 14 slip from between strips 35 and 36 after travelling different distances down tube 11, the degree to which they are deflected by a given setting of the deflectors 45 and 46 varies. This provides the random spread of thrown balls 14. To set a limit to the lateral range of balls 14 to keep them hitting a table tennis table when expelled at a given velocity, the deflectors 45 and 46 are each rotated to one of six positions by the nobs 51 and 52 to present specific faces 70–75 to the interior of barrel 10. The faces 70–75 have different angles and project to different extents so that face 70, as shown in FIG. 6, if turned inward would only slightly deflect a ball 14. Face 75 would deflect a ball 14 to the maximum extent.

Thus, with a given setting of nobs 51 and 52, a random lateral variation of thrown balls 14 can be provided. As shown in FIG. 5, the rear Z-bend 37 of strip 35 can move from side to side in the wide aperture 19. Since there is a violent vibration of strips 35 and 36 during the passage of a ball 14, the rear ends of strips 35 and 36 shift from side to side to decrease the possibility that a large number of balls 14 will pass straight down the center of tube 11; because, if the rear end of a strip 35 or 36 happens to be shifted to one side as a ball 14 enters tube 11, the ball 14 is more likely to be forced to one side or the other by the spring pressure of the strips 35 and 36. The limits of this lateral shift of the Z-bend 37 is shown in phantom lines in FIG. 5.

Figure 5A:
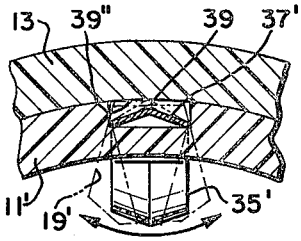
FIG. 5A is a section taken on line 5—5 of FIG. 1 showing a modified upper ball contact strip.

FIG. 5A shows a modified rear ending of the upper and lower strips 35 and 36. The strip 35′ ends in a Z-bend 37′ which extends through a narrow aperture 19′. A reverse crown 39 is formed at the end of Z-bend 37′ to extend within slot 39″. This construction allows the back ends of upper or lower strips 35′ to pivot or swing from side to side as shown in phantom lines. As a ball 14 pushes a strip 35′ outward, the strip 35′ will freely pivot about the reverse crown 39 unless a ball 14 is exactly centered under or over it.

Figure 6A:
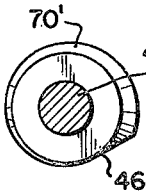
FIG. 6A is a transverse section taken through the shaft of an adjustable deflector, the deflector being modified.

FIG. 6A shows a second modification of the first embodiment of this invention. A shaft 48′ has a deflector 46′ mounted thereon, the deflector 46′ having a single smooth surface 70′ which increasingly slopes to more greatly deflect balls 14 according to how deflector 46′ is turned to be positioned in barrel 10. Two deflectors 46′ would be used to replace the deflectors 45 and 46. They would be held in positions in which they were set by the frictional contact of the detent springs 53 and 54.

Referring again to FIG. 2, if it is desired to practice a single table tennis shot, a side strip 29 or 30 can have its front end moved inward as shown in phantom lines. The ball 14 will then always be forced to strike a given deflector 45 or 46 to be consistently deflected in the same direction as shown by the arrow adjacent to the ball 14 shown in phantom lines. The side strips 29 and 30 can be held in inward positions by selectively hooking portions of their zig zag ends 33 and 34 in given positions in the apertures 25 and 26.

If it is desired to impart a strong spin to a ball 14, a thin abrasive, rubber, or other high friction coating 8 or 9 can be placed on a strip 29, 30, 35, or 36 as shown in FIG. 4. Coating 8 on a side strip 29 or 30 will give a ball a strong side spin and coating 9 on upper or lower strips 35 and 36 will give a ball a strong back or over spin. Since strips 29, 30, 35, and 36 are easily removed and replaced, strips with coatings 8 or 9 can be quickly and easily installed to practice given table tennis returns.

Figure 8:
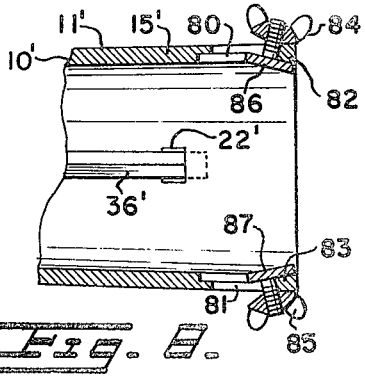
FIG. 8 is a longitudinal, horizontal section through a broken away muzzle of a barrel showing a second embodiment of my invention.

FIG. 8 shows a second embodiment of this invention in which a barrel 10′ has a tube 11′ diverging toward its muzzle end 15′. Tube 11′ is substantially identical to the tube of the first embodiment except the side strips are omitted to lower costs and simplify construction. Upper and lower strips are provided and lower strip 36′ is shown extending into an aperture 22′. Adjustment screws 55 and 56 of the first embodiment are omitted. Strips 36′ are removed and flexed if they lose their spring producing longitudinal camber or curve. Slots 80 and 81 have wedge shaped ends 82 and 83 so that wing nuts 84 and 85 can secure the deflectors 86 and 87 along the slots 80 and 81 to have them project a desired distance at a desired angle into the muzzle of tube 11′. Sliding the deflectors 86 and 87 longitudinally adjusts the maximum deflection of balls 14 being thrown.

To throw balls in one direction to practice a given shot, the deflectors 86 and 87 are moved rearwardly in slots 80 and 81 to withdraw them from tube 11′ which must then be aimed in the direction desired. In throws of three meters, balls 14 will only deviate laterally due to the flaring of muzzle 15′ a few centimeters. When the deflectors 86 and 87 are adjusted for maximum deflection, balls 14 will deviate over a meter in both directions in throws of 3 meters.

If the barrel 10 of the first embodiment of this invention is used without side strips 29 and 30 which are easily removed, or if it is used with fully retracted and uncoated side strips 29 and 30, the center strips 35 and 36 will pinch a ball 14 which is deviating to the right as shown in FIG. 2 to give the ball 14 a slight counterclockwise spin as it reaches muzzle 15. This counterclockwise spin is substantially neutralized by the clockwise spin induced as ball 14 strikes deflector 45. Thus balls 14 normally leave the barrels 10 and 10′ with almost no spin unless a spin is intentionally induced by means of coated strips as has been described.

The barrels 10 and 10′ of this invention not only randomly vary the directions of thrown balls 14, but they vary the speed of the thrown balls 14 because, if a ball 14 remains centered between the upper and lower spring strips 35 and 36 for most of its travel down a barrel 10, the spring pressure these strips 35 and 36 exert will slow a ball 14 down. At the last moment of travel in a barrel 10 or 10', a ball 14 may slip from between strips 35 and 36 to be deflected to the maximum extent or it may continue as a relatively straight throw. A ball 14 spending most of its travel centered between the strips 35 and 36 will be thrown with a lower velocity than a ball 14 which slips from between the strips 35 and 36 early in its travel down a barrel 10 or 10'.

In the practice of this invention if the strips 35 and 36 are too weak in their ball engaging spring pressure, too many balls 14 will be blown directly down the center of tube 11. If they are too strong in their inwardly exerted spring pressure, the velocity at which balls 14 are expelled will be too slow and there will be fewer straight throws. It has been found best to have the strips 35 and 36 exert a relatively weak spring pressure on the balls 14 and to have the back ends of the strips 35 and 36 free to move easily from side to side. This best provides throws of random directions at the highest possible velicity.

The barrel 10 of this invention may function with one of the upper or lower strips 35 or 36 rigid and extending into the tube 11 and the other of the strips 35 or 36 of spring or other material that extends elastically or resiliently into the tube 11 to co-act with the first strip. The strips thus exert a pressure on a ball 14 that is between them to squeeze imperfectly centered balls 14 to the right or left to contact a rigid deflector at the muzzle as has been described.

While this invention has been shown and described in the best forms known, these are purely exemplary and modifications may be made without departing from the spirit of the invention.

I claim:

1. A barrel for a ball throwing machine which blows table tennis balls from said barrel comprising, in combination, a tubular barrel having a muzzle which flares laterally, one upper ball contact strip and one lower ball contact strip extending into said barrel and along said barrel to said muzzle, at least one of said contact strips elastically extending into said barrel, said contact strips contacting table tennis balls passing therebetween through said barrel so that said balls may randomly slip laterally from between said contact strips on reaching said laterally flared muzzle, and rigid deflectors disposed on each side of said laterally flared muzzle and projecting inward so that balls randomly slipping from between said contact strips in one lateral direction strike one of said deflectors to bounce and be deflected to a greater extent in the opposite lateral direction.

2. The combination according to claim 1 wherein both said upper and lower ball contact strips have crowns which elastically extend into said barrel contacting balls passing therebetween.

3. The combination according to claim 2 wherein said upper and lower ball contact strips are of spring material and have front and rear ends, and with the addition of means securing said upper and lower contact strip ends to said barrel, said upper and lower contact strips each having a longitudinal camber extending into said barrel.

4. The combination according to claim 3 with the addition of means longitudinally compressing the ends of said upper and lower contact strips providing at least some of the camber of said upper and lower contact strips.

5. The combination according to claim 4 wherein said means longitudinally compressing the ends of said upper and lower contact strips are adjustment screws turned against one end of each of said contact strips.

6. The combination according to claim 3 wherein said barrel contains apertures and said means securing said upper and lower contact strip ends to said barrel are Z-bends at the ends of said contact strips, said Z-bends extending through said apertures in said barrel, said apertures receiving the rear end Z-bends of said contact strips being wider than said Z-bends allowing lateral movement of the rear ends of said contact strips.

7. The combination according to claim 2 with the addition of side strips having front and rear ends, means securing the rear ends of said side strips to said barrel, and means adjustable securing the front ends of said side strips to project into the muzzle of said barrel distances equal to the lateral flare of said barrel.

8. The combination according to claim 7 wherein at least one of said strips has a coating of high friction material imparting a large spin to a ball contacting said coating.

9. The combination according to claim 7 wherein said barrel contains longitudinal grooves, said strips being disposed in said grooves.

10. The combination according to claim 1 with the addition of means adjustably mounting said deflectors to adjustably project said deflectors inward thereby adjusting limits of the random lateral deflection of balls thrown therefrom.

11. The combination according to claim 10 wherein said deflectors have a plurality of differently sloping faces and said means adjustably mounting said deflectors are longitudinal shafts on which said deflectors are mounted, and with the addition of adjustment nobs on said shafts to rotate said shafts and thereby said deflectors to position selected pairs of said sloping faces of said deflectors inward, and detent means securing said deflectors in given rotational positions.

12. The combination according to claim 11 wherein said plurality of differently sloping faces of said deflectors are a single unbroken surface of each deflector which increasingly slopes about the deflector.

13. The combination according to claim 1 wherein said barrel contains slots adjacent to said muzzle, and with the addition of wedge shaped ends of said slots projecting inward at the front of said slots, and means extending through said slots adjustably fixing said deflectors against said wedge shaped ends to thereby adjustably project into said barrel according to the longitudinal positioning of said deflectors by said means extending through said slots.

* * * * *